US008425261B2

(12) United States Patent
Pepe

(10) Patent No.: US 8,425,261 B2
(45) Date of Patent: Apr. 23, 2013

(54) ELECTRICAL CONNECTOR WITH CONTACT SPACING MEMBER

(75) Inventor: Paul John Pepe, Clemmons, NC (US)

(73) Assignee: Tyco Electronics Corporation, Berwyn, PA (US)

( * ) Notice: Subject to any disclaimer, the term of this patent is extended or adjusted under 35 U.S.C. 154(b) by 152 days.

(21) Appl. No.: 13/032,447

(22) Filed: Feb. 22, 2011

(65) Prior Publication Data

US 2011/0143605 A1 Jun. 16, 2011

Related U.S. Application Data

(63) Continuation-in-part of application No. 12/396,211, filed on Mar. 2, 2009, now Pat. No. 7,927,152.

(51) Int. Cl.
*H01R 24/00* (2011.01)

(52) U.S. Cl.
USPC ..... 439/676; 439/941

(58) Field of Classification Search ..... 439/76.1, 439/404, 676, 941
See application file for complete search history.

(56) References Cited

U.S. PATENT DOCUMENTS

| | | | | |
|---|---|---|---|---|
| 4,806,117 | A * | 2/1989 | Johnston | 439/344 |
| 5,178,563 | A | 1/1993 | Reed | |
| 5,186,647 | A | 2/1993 | Denkmann et al. | |
| 5,362,257 | A | 11/1994 | Neal et al. | |
| 5,587,884 | A | 12/1996 | Raman | |
| 5,915,989 | A | 6/1999 | Adriaenssens et al. | |
| 6,217,352 | B1 * | 4/2001 | Oliphant et al. | 439/131 |
| 6,767,257 | B2 | 7/2004 | Arnett et al. | |
| 6,769,936 | B2 | 8/2004 | Gutierrez et al. | |
| 7,533,196 | B2 * | 5/2009 | Tojima et al. | 710/22 |
| 7,568,938 | B2 * | 8/2009 | Siev et al. | 439/404 |
| 7,618,296 | B2 * | 11/2009 | Caveney | 439/676 |
| 7,927,152 | B2 * | 4/2011 | Pepe et al. | 439/676 |
| 2008/0064266 | A1 * | 3/2008 | Givens et al. | 439/676 |
| 2010/0041274 | A1 * | 2/2010 | Marti et al. | 439/607.01 |

FOREIGN PATENT DOCUMENTS

| | | | |
|---|---|---|---|
| EP | 1858125 | A1 | 11/2007 |
| WO | 2005101579 | A1 | 10/2005 |

* cited by examiner

*Primary Examiner* — Khiem Nguyen

(57) ABSTRACT

A contact sub-assembly is provided for an electrical connector. The contact sub-assembly includes a base having a base surface, and an array of contacts that extend along the base surface of the base. Each contact extends along a length from a terminating end to a tip end. Each contact has a mating interface located along the length of the contact between the terminating end and the tip end. The contact sub-assembly also includes a spacing member formed separately from the base. The spacing member engages at least some of the contacts for positioning the contacts relative to each other within the array. The spacing member includes first and second spacing segments that are discrete from each other and that are configured to move relative to each other.

20 Claims, 5 Drawing Sheets

ELECTRICAL CONNECTOR WITH CONTACT SPACING MEMBER

CROSS-REFERENCE TO RELATED APPLICATIONS

This application is a continuation-in-part of U.S. application Ser. No. 12/396,211,entitled "Electrical Connector With Contact Spacing Member", and filed on Mar. 2, 2009. The disclosure of the above listed application is incorporated by reference herein in its entirety.

BACKGROUND OF THE INVENTION

The subject matter described and/or illustrated herein relates generally to electrical connector assemblies.

Electrical connector assemblies are commonly used in communication and/or network systems to provide an interface between successive runs of cables and/or between cables and electronic devices of the system. Some of such electrical connector assemblies include a jack that is configured to be joined with a plug. The jack includes a contact sub-assembly having an array of mating contacts. Each of the mating contacts of the contact sub-assembly includes a mating interface that engages a corresponding contact of the plug. At least some known contact sub-assemblies include a dielectric spacing member that surrounds the mating contacts within the array to position the mating contacts relative to each other within the array. For example, the spacing member may space the mating interfaces of adjacent mating contacts within the array by a predetermined pitch.

Electrical connector assemblies that are commonly used in communication and/or network systems include Registered Jack-11 (RJ-11) and Registered Jack-45 (RJ-45) wiring standards. RJ-11 is a six position two-wire connector assembly typically used to interconnect telephone equipment. RJ-45 is an eight position eight-wire connector assembly that is typically used to connect computers and/or other devices to local are networks (LANs), for example Ethernet networks. The plugs of RJ-11 connector assemblies are smaller than the jacks of RJ-45 connector assemblies such that an RJ-11 plug can be inserted into an RJ-45 jack. RJ-11 and RJ-45 connector assemblies have similar geometries such that RJ-11 and RJ-45 connector assemblies physically resemble each other. Further, RJ-11 and RJ-45 jacks are sometimes located proximate each other within a system. Accordingly, RJ-11 plugs are sometimes accidentally inserted into RJ-45 jacks.

RJ-45 jacks can be damaged when an RJ-11 plug is inserted therein. For example, RJ-11 plugs include raised extensions that extend on either side of the array of contacts thereof. When an RJ-11 plug is inserted into an RJ-45 jack, the raised extensions press against the two outermost contacts within the array of mating contacts of the RJ-45 jack. The force applied to the two outermost contacts of the RJ-45 jack by the raised extensions of the RJ-11 plug cause the spacing member to deform the two outermost contacts, thereby damaging them. When an RJ-45 plug is inserted into the RJ-45 jack, such damage to the two outermost contacts of the RJ-45 jack may result in an insufficient contact force between the mating contacts of the RJ-45 jack and the corresponding contacts of the RJ-45 plug, which may result in poor electrical performance.

BRIEF DESCRIPTION OF THE INVENTION

In one embodiment, a contact sub-assembly is provided for an electrical connector. The contact sub-assembly includes a base having a base surface, and an array of contacts extending along the base surface of the base. Each contact extends along a length from a terminating end to a tip end. Each contact has a mating interface located along the length of the contact between the terminating end and the tip end. The contact sub-assembly also includes a spacing member formed separately from the base. The spacing member engages at least some of the contacts for positioning the contacts relative to each other within the array. The spacing member includes first and second spacing segments that are discrete from each other and that are configured to move relative to each other.

In another embodiment, an electrical connector includes a housing and a contact sub-assembly held by the housing. The contact sub-assembly includes a base having a base surface, and an array of contacts extending along the base surface of the base. Each contact extends along a length from a terminating end to a tip end. Each contact has a mating interface located along the length of the contact between the terminating end and the tip end. The contact sub-assembly includes a spacing member formed separately from the base. The spacing member engages at least some of the contacts for positioning the contacts relative to each other within the array. The spacing member includes first and second spacing segments that are discrete from each other and that are configured to move relative to each other.

In another embodiment, a contact sub-assembly is provided for an electrical connector. The contact sub-assembly includes a base having a base surface, and an array of contacts extending along the base surface of the base. Each contact extends along a length from a terminating end to a tip end. Each contact has a mating interface located along the length of the contact between the terminating end and the tip end. The contact sub-assembly includes a spacing member formed separately from the base. The spacing member covers the contacts along a portion of the length thereof. The spacing member is segmented into first and second spacing segments that are discrete from each other and that are configured to move independently from each other.

DETAILED DESCRIPTION OF THE INVENTION

Figure 1:
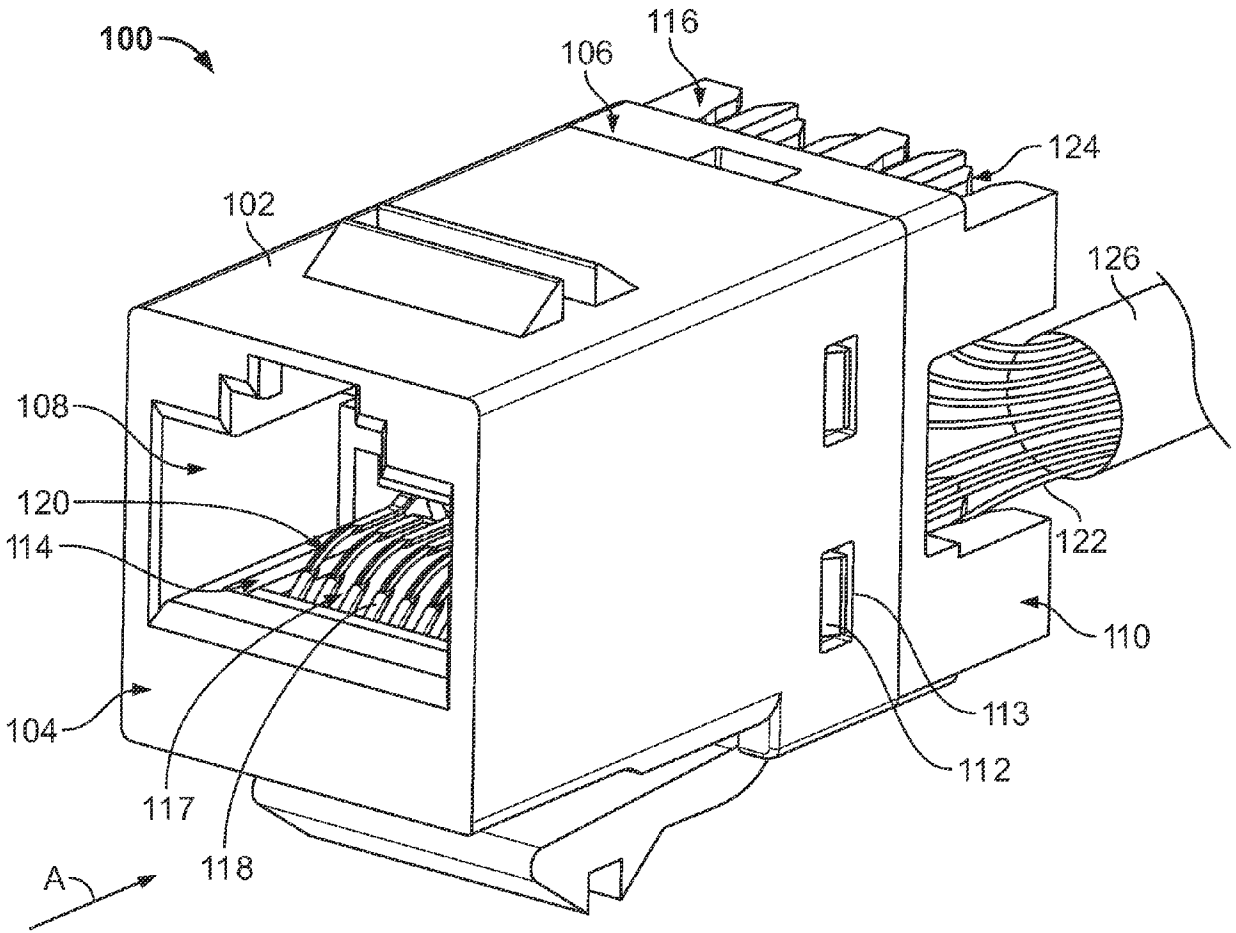
FIG. 1 is perspective view of an exemplary embodiment of an electrical connector.

FIG. 1 is perspective view of an exemplary embodiment of an electrical connector 100. In the exemplary embodiment, the connector 100 is a modular connector, such as, but not limited to, an RJ-45 outlet or jack. The connector 100 is configured for joining with a mating plug (not shown). The mating plug is loaded along a mating direction, shown generally by arrow A. The connector 100 includes a housing 102 extending from a mating end 104 to a terminating end 106. A cavity 108 extends between the mating end 104 and the terminating end 106. The cavity 108 receives the mating plug through the mating end 104.

The connector 100 includes a contact sub-assembly 110 received within the housing 102 through the terminating end 106 of the housing 102. In the exemplary embodiment, the contact sub-assembly 110 is secured to the housing 102 via tabs 112 that cooperate with corresponding openings 113 within the housing 102. The contact sub-assembly 110 extends from a mating end 114 to a terminating end 116. The contact sub-assembly 110 is held within the housing 102 such that the mating end 114 of the contact sub-assembly 110 is positioned proximate the mating end 104 of the housing 102. The terminating end 116 extends outward from the terminating end 106 of the housing 102. The contact sub-assembly 110 includes an array 117 of a plurality of contacts 118. Each contact 118 within the array 117 includes a mating interface 120 arranged within the cavity 108. Each mating interface 120 engages a corresponding contact (not shown) of the mating plug when the mating plug is mated with the connector 100. The arrangement of the contacts 118 may be controlled by industry standards, such as, but not limited to, IEC 60603-7. In an exemplary embodiment, the connector 100 includes eight contacts 118 arranged as differential pairs. However, the connector 100 may include any number of contacts 118, whether or not the contacts 118 are arranged in differential pairs.

In the exemplary embodiment, a plurality of communication wires 122 are attached to terminating portions 124 of the contact sub-assembly 110. The terminating portions 124 are located at the terminating end 116 of the contact sub-assembly 110. Each terminating portion 124 is electrically connected to a corresponding one of the contacts 118. The wires 122 extend from a cable 126 and are terminated to the terminating portions 124. Optionally, the terminating portions 124 include insulation displacement connections (IDCs) for terminating the wires 122 to the contact sub-assembly 110. Alternatively, the wires 122 may be terminated to the contact sub-assembly 110 via a soldered connection, a crimped connection, and/or the like. In the exemplary embodiment, eight wires 122 arranged as differential pairs are terminated to the connector 100. However, any number of wires 122 may be terminated to the connector 100, whether or not the wires 122 are arranged in differential pairs. Each wire 122 is electrically connected to a corresponding one of the contacts 118, as will be described below. Accordingly, the connector 100 provides electrical signal, electrical ground, and/or electrical power paths between the mating plug and the wires 122 via the contacts 118 and the terminating portions 124.

Figure 2:
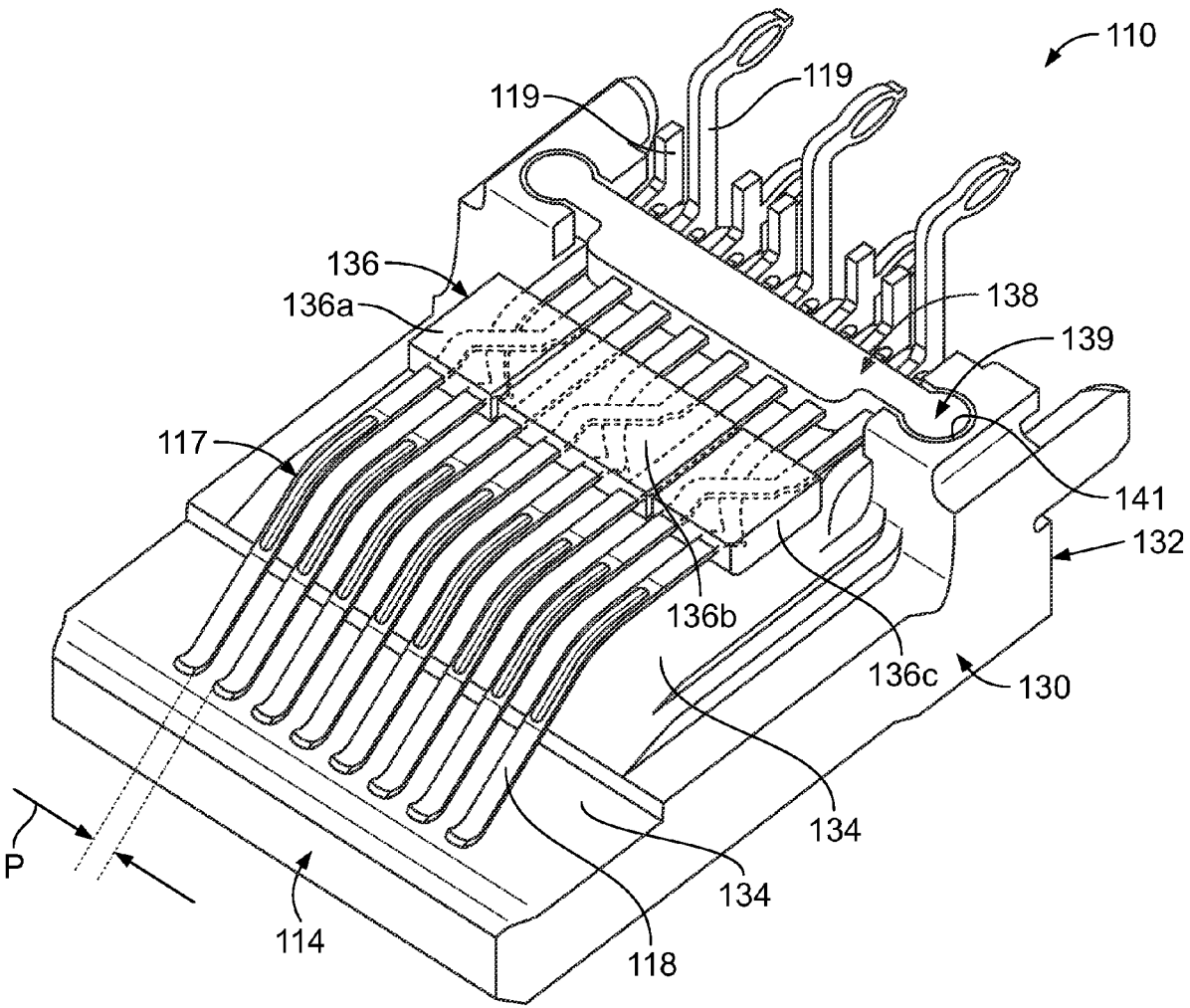
FIG. 2 is a perspective view of an exemplary embodiment of a contact sub-assembly of the electrical connector shown in FIG. 1.

FIG. 2 is a perspective view of an exemplary embodiment of the contact sub-assembly 110. The contact sub-assembly 110 includes a base 130 that extends from the mating end 114 to an opposite end 132. Optionally, a circuit board (not shown) is mounted on the end 132 for establishing the electrical connections between the terminating portions 124 (FIG. 1) and the corresponding contacts 118. The base 130 includes an upper surface 134 along which contact array 117 extends. More particularly, the contacts 118 extend above and along the surface 134 in a direction that is generally parallel to the loading direction (shown in FIG. 1 by arrow A) of the mating plug (not shown). The upper surface 134 may be referred to herein as a "base surface".

The contact sub-assembly 110 includes a spacing member 136 engaged with the contact array 117. The spacing member 136 positions at least some of the contacts 118 relative to at least some other contacts 118 within the array 117. For example, the spacing member 136 may facilitate spacing the mating interfaces 120 of at least some of the contacts 118 apart from each other by a predetermined pitch P. The spacing member 136 may also facilitate preventing adjacent contacts 118 from engaging and thereby electrically shorting. As will be described in more detail below, the spacing member 136 is formed separately from the base 130 and includes at least two spacing segments (e.g., the spacing segments 136*a*,136*b*,and/or 136*c*) that are discrete from each other and that are configured to move relative to each other.

Optionally, the contact sub-assembly 110 includes another spacing member 138, which optionally includes a latch feature 139 that cooperates with a latch member 141 of the base 130 to facilitate holding the contact array 117 on the base 130. In the exemplary embodiment, the latch feature 139 is a post and the latch member 141 is an opening, wherein the post is received within the opening with an interference fit. But, the latch feature 139 and the latch member 141 may each have any other type of structure that enables the latch feature 139 and the latch member 141 to cooperate to facilitate holding the contact array 117 on the base 130. In the exemplary embodiment, the contact array 117 is held by the base 130 via the mechanical connection between the spacing member 138 and the base 130. However, in addition or alternative to the spacing member 138, the contact array 117 is held by base 130 via the spacing member 136 and/or another component of the array 117 (e.g., one or more of the contacts 118). Moreover, in some alternative embodiments, the contact array 117 is not held by the base 130, but rather is held by another component of the electrical connector 100 (FIG. 1), such as, but not limited to, the optional circuit board that is mounted on the end 132 of the base 130.

Figure 3:
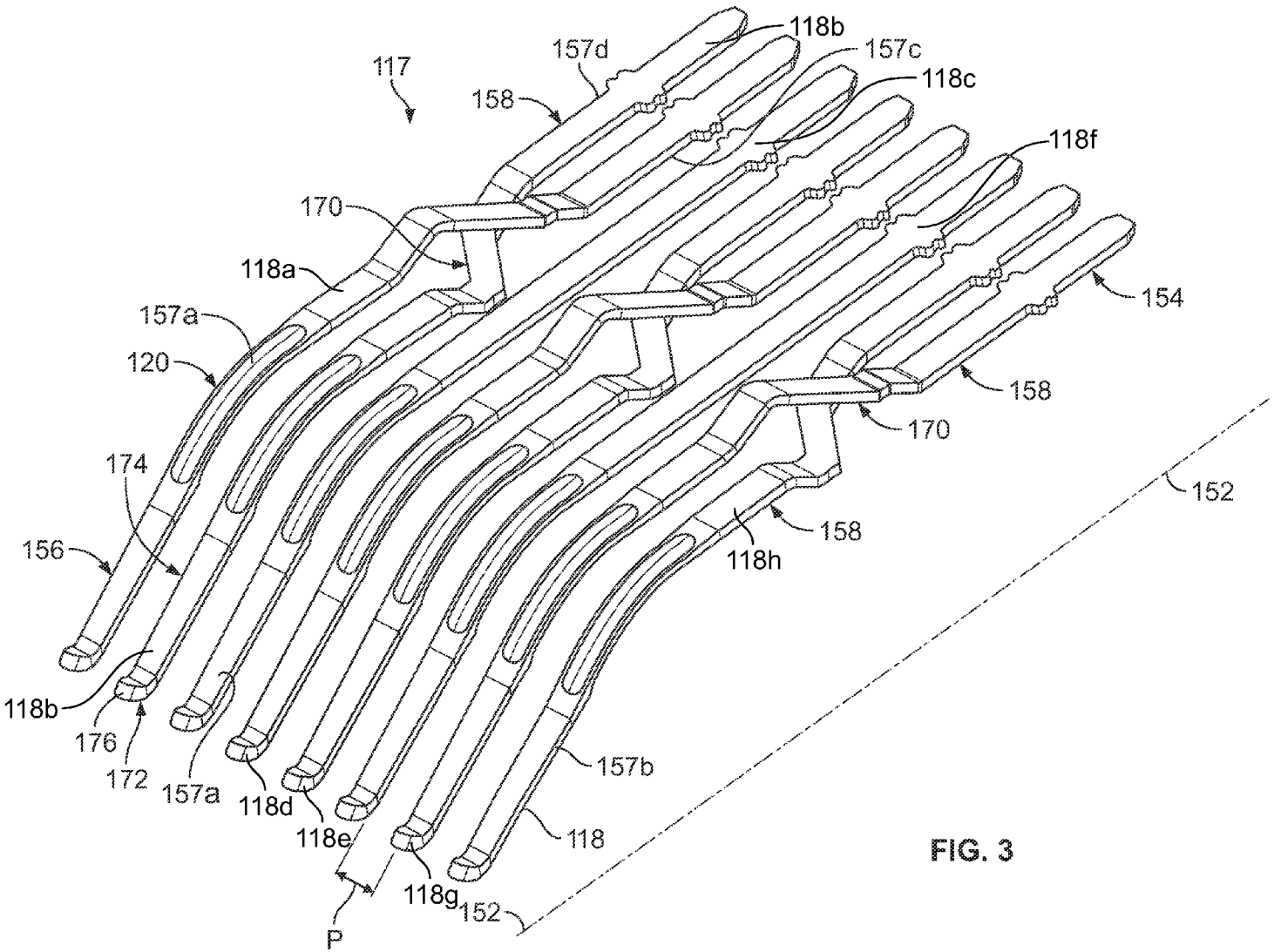
FIG. 3 is a perspective view of an exemplary embodiment of an array of contacts of the contact sub-assembly shown in FIG. 2.

FIG. 3 is a perspective view of an exemplary embodiment of the contact array 117. In the exemplary embodiment, the contact array 117 includes eight contacts 118 arranged as differential contact pairs. However, the contact array 117 may include any number of contacts 118, whether or not the contacts 118 are arranged in differential pairs. The eight contacts 118 within the exemplary array 117 are arranged to include two opposite outer contacts 118*a* and 118*h* and six inner contacts 118*b-g* that extend between the outer contacts 118*a* and 118*h*,as can be seen in FIG. 3. The configuration, arrangement, relative positions, relative locations, geometry, shape, size, and/or the like of the contacts 118 that is described and/or illustrated herein is meant as exemplary only. The contacts 118 may have other configurations, arrangements, relative positions, relative locations, geometries, shapes, sizes, and/or the like than is shown and/or described herein.

Each contact 118 extends a length along a contact axis 152 from a terminating end 154 to a tip end 156. Although the contacts 118 are shown as each having approximately the same length, one or more of the contacts 118 may alternatively have a different length than one or more of the other contacts 118 within the array 117. An intermediate segment 158 extends between the terminating end 154 and the tip end 156 of each contact 118. As described above, each contact 118 includes the mating interface 120, which extends between the intermediate segment 158 and the tip end 156. Specifically, the intermediate segment 158 extends from the terminating end 154 to the mating interface 120, and the mating interface 120 extends from the intermediate segment 158 to the tip end 156. Each contact 118 includes an outer surface 157 that extends along the length of the contact 118 from the terminating end 154 to the tip end 156. In the exemplary embodiment, the outer surface 157 includes four sides 157*a*,157*b*, 157*c*,and 157*d* such that each contact 118 includes an approximately rectangular cross-sectional shape.

However, the outer surface 157 of each contact 118 may include any number of sides and each contact 118 may have any cross-sectional shape.

Figure 6:
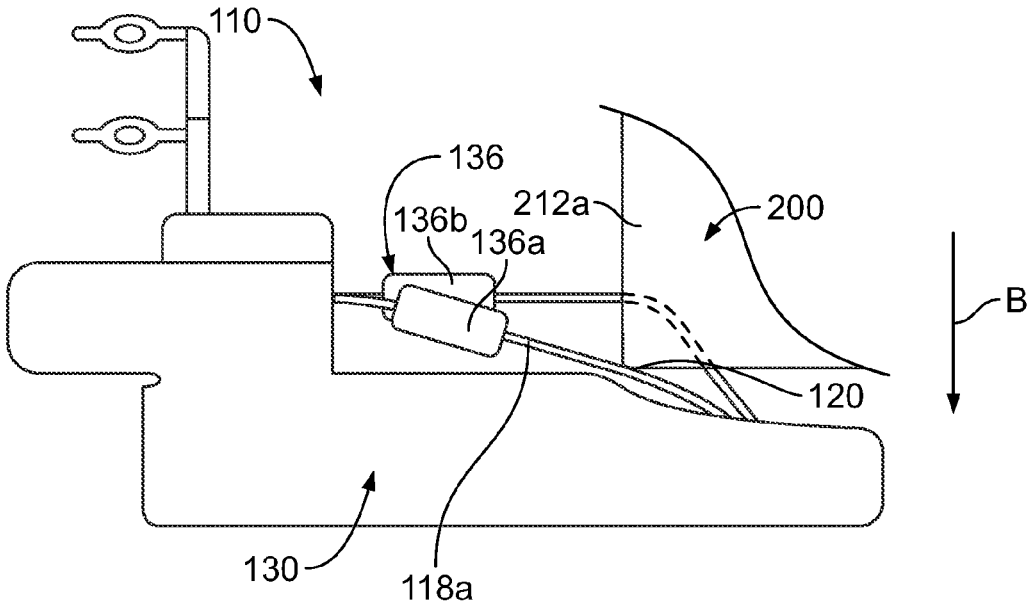
FIG. 6 is a side elevational view of the contact sub-assembly shown in FIG. 2.

The terminating end 154 of each contact 118 optionally terminates to the circuit board that is mounted on the end 132 (FIG. 3) of the base 130 (FIGS. 2 and 6). In the exemplary embodiment, the terminating ends 154 are terminated to the circuit board via intervening electrical contacts 119 (FIG. 2) that engage the terminating ends 154. Alternatively, the terminating ends 154 are directly terminated to the circuit board that is mounted on the end 132 of the base 130, for example by being received within corresponding vias (not shown) of the circuit board. Moreover, in some other alternative embodiments, the terminating end 154 of one or more of the contacts 118 is directly terminated to a corresponding one of the wires 122 (FIG. 1). Optionally, a portion of the terminating end 154 may extend non-parallel to the contact axis 152 to change the elevation of the contact 118 with respect to the base 130 of the contact sub-assembly 110 (FIGS. 1, 2, and 6).

The intermediate segment 158 of each contact 118 extends from the terminating end 154 to the mating interface 120. Optionally, the intermediate segment 158 of one or more of the contacts 118 includes a cross-over segment 170 that crosses over or under the intermediate segment 158 of an adjacent contact 118. In the exemplary embodiment, six of the eight contacts 118 within the contact array 117 include a cross-over segment 170. However, any number of the contacts 118 within the contact array 117 may include a cross-over segment 170.

As described above, the mating interface 120 of each contact 118 extends from the intermediate segment 158 to the tip end 156. In the exemplary embodiment, the mating interface 120 is a curved portion. However, the mating interface 120 may have any size, shape, geometry, and/or the like. The mating interfaces 120 are positioned to engage the mating plug (not shown) when the mating plug is mated with the electrical connector 100 (FIG. 1). Specifically, a portion of the outer surface side 157*a* that extends along the mating interface 120 engages a corresponding contact (not shown) of the mating plug. As can be seen in FIG. 3, in the exemplary embodiment each contact 118, and more specifically the mating interface 120 of each contact 118, is spaced apart from each adjacent contact by the predetermined pitch P.

The tip end 156 of each contact 118 includes a tip 172 and a leg 174. The leg extends from the mating interface 120 to the tip 172. The tip 172 extends outwardly from the leg 174 to an outermost tip surface 176. Optionally, the leg 174 of each contact 118 is angled relative to the intermediate segment 158, as can be seen in FIG. 3. In the exemplary embodiment, the tips 172 of each of the contacts 118 are aligned along a single plane. Alternatively, the tips 172 may be arranged on multiple planes. In the exemplary embodiment, the tips 172 engage the upper surface 134 (FIG. 2) of the base 130 (FIGS. 2 and 6). In some alternative embodiments, the tips 172 engage a circuit board (not shown) that is held within the base 130. In such an alternative embodiment, the tips 172 engage the circuit board through one or more openings (not shown) that extend through the upper surface 134 of the base 130.

Figure 4:
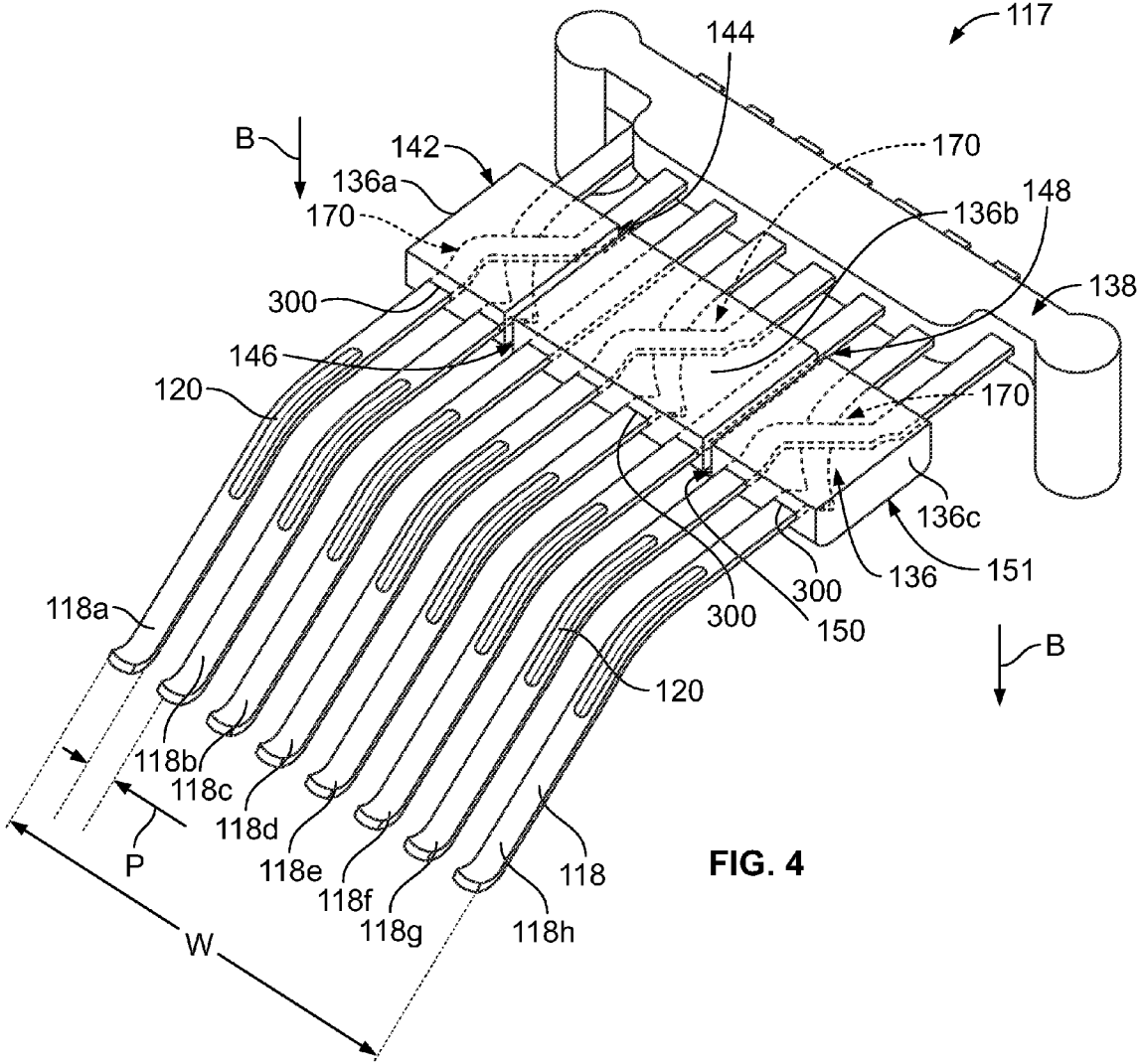
FIG. 4 is a perspective view of a portion of the contact array shown in FIG. 3 having an exemplary embodiment of a spacing member engaged therewith.

FIG. 4 is a perspective view of a portion of the contact array 117 having exemplary embodiments of the spacing members 136 and 138 engaged therewith. The terminating ends 154 of the contacts 118 are not shown in FIG. 4. The spacing member 136 positions the contacts 118 relative to each other within the array 117. For example, the spacing member 136 may facilitate spacing the mating interfaces 120 of the contacts 118 apart from each other by the predetermined pitch P. The spacing member 136 may also facilitate preventing adjacent contacts 118 from engaging and thereby electrically shorting. The spacing member 136 positions the contacts 118 relative to each other via engagement with at least some of the contacts 118. The spacing member 136 is formed separately from the base 130 (FIGS. 2 and 6). As used herein, things that are "formed separately" are not connected together during formation.

As briefly described above, the spacing member 136 includes at least two spacing segments (e.g., the spacing segments 136*a*,136*b*,and/or 136*c*) that are discrete from each other and that are configured to move relative to each other. The spacing member 136 is segmented into the at least two spacing segments. As used herein, the term "discrete" is intended to mean constituting a separate part or component. In some embodiments, one or more of the spacing segments of the spacing member 136 is formed separately from one or more of the other spacing segments of the spacing member 136. For example, in some embodiments, each spacing segment of the spacing member 136 is formed separately from each other spacing segment of the spacing member 136. In some embodiments, two or more of the spacing segments of the spacing member 136 are formed integrally with each other and thereafter severed from each other to define the discrete spacing segments. For example, in some embodiments, the spacing member 136 is formed as a single component that is thereafter severed to define at least two discrete spacing segments.

The spacing member extends across a width W of the contact array 117. The exemplary embodiment of the spacing member 136 is segmented into three spacing segments 136*a*, 136*b*,and 136*c*. But, the spacing member 136 may have any number of spacing segments. The spacing segments 136*a*, 136*b*,and 136*c* are discrete from each other and are arranged in a row that extends across the width W of the contact array 117. In the exemplary embodiment, the spacing segment 136*a* engages the contacts 118*a* and 118*b*,the spacing segment 136*b* engages the contacts 118*c-f*,and the spacing segment 136*c* engages the contacts 118*g* and 118*h*. But, each spacing segment 136*a*,136*b*,and 136*c* may engage any of the contacts 118. Moreover, each spacing segment 136*a*,136*b*, and 136*c* may engage any number of the contacts 118. In the exemplary embodiment, the spacing segment 136*a* engages the contacts 118*a* and 118*b* at the cross-over segments 170 thereof. Similarly, the spacing segment 136*b* engages the contacts 118*d* and 118*e* at the cross-over segments 170 thereof, and the spacing segment 136*c* engages the contacts 118*g* and 118*h* at the cross-over segments 170 thereof. In some alternative embodiments wherein the contacts 118*a* and 118*b* do not include the cross-over segments 170, the spacing segment 136*b* engages the contact 118*b* and the only contact 118 engaged by the spacing segment 136*a* is the contact 118*a*. In some alternative embodiments wherein the contacts 118*g* and 118*h* do not include the cross-over segments 170, the spacing segment 136*b* engages the contact 118*g* and the only contact 118 engaged by the spacing segment 136*c* is the contact 118*h*. Each of the spacing segments 136*a*,136*b*,and 136*c* may be referred to herein as a "first spacing segment", a "second spacing segment", and/or a "third spacing segment".

The spacing segment 136*a* extends from an end 142 to an opposite end 144. The end 142 of the spacing segment 136*a* defines an end of the spacing member 136. The spacing segment 136*b* extends from an end 146 to an opposite end 148. The end 146 of the spacing segment 136*b* faces the end of the 144 of the spacing segment 136*a*. Although in the exemplary embodiment a gap is shown between the ends 144 and 146 of the spacing segments 136*a* and 136*b*,respectively, alternatively the ends 144 and 146 abut each other. The spacing segment 136*c* extends from an end 150 to an opposite end 151. The end 151 of the spacing segment 136*c* defines an end of the spacing member 136. In the exemplary embodiment, the end 148 of the spacing segment 136*b* is spaced apart from the end 150 of the spacing segment 136*c*. Alternatively, the ends 148 and 150 of the respective spacing segments 136*b* and 136*c* abut each other.

The spacing segments 136*a* and 136*c* are each configured to move relative to the spacing segment 136*b*. In other words, the spacing segments 136*a* and 136*c* are each configured to move independently from the spacing segment 136*b*. For example, the spacing segments 136*a* and 136*c* are each configured to move relative to the spacing segment 136*b* generally in the direction of the arrow B. When the mating interface 120 of the contact 118*a* is deflected in the direction of the arrow B, the spacing segment 136*a* moves along with the contact 118*a*.

In some circumstances, for example the insertion of an incorrect (or wrong) mating plug, the mating interfaces 120 of one or more of the contacts 118 within the array 117 may be deflected a greater amount in the direction of the arrow B than the mating interfaces 120 one or more other contacts 118 within the array 117. For example, insertion of the wrong mating plug may deflect the mating interfaces 120 of the contacts 118*a* and 118*h* a greater amount than the contacts 118*b-g*. Notably, in the exemplary embodiment, the mating interfaces 120 of the contacts 118*b* and 118*g* are deflected by the wrong mating plug a lesser amount (or not at all) than the mating interfaces 120 of the contacts 118*a* and 118*h*. However, and as will be described below, the mating interfaces 120 of the contacts 118*b* and 118*g* may deflect along with (e.g., approximately the same amount as) the mating interfaces 120 of the contacts 118*a* and 118*h*,respectively, because of the interconnection between the contacts 118*a* and 118*b* provided by the spacing segment 136*a* and the interconnection between contacts 118*g* and 118*h* provided by the spacing segment 136*c*.

If the spacing member 136 was formed as a single component that engaged all of the contacts 118, instead of having the discrete segments, the natural bias of the six contacts 118*b-g* provides a resistance force that may be high enough to cause the spacing segments 136*a* and/or 136*c* to deform and thereby damage the contacts 118*a* and/or 118*h*,respectively.

However, as a result of the embodiments of the present invention described and/or illustrated herein, the independent movement of the spacing segment 136*a* with respect to the spacing segment 136*b* enables the mating interface 120 of the contact 118*a* to be deflected a greater amount, by the wrong mating plug, than the mating interfaces 120 of the contacts 118*b-g* without damaging the contact 118*a*. More specifically, the independent movement of the spacing segment 136*a* relative to the spacing segment 136*b* enables the portion (e.g., the cross-over segment 170, if included) of the contact 118*a* that is engaged by the spacing segment 136*a* to move relative to the portions of the contacts 118*c-f* that are engaged by the spacing segment 136*b*. Accordingly, the contacts 118*c-f* and the spacing segment 136*b* do not resist the greater deflection of the mating interface 120 of the contact 118*a* and the resulting deflection of the portion of the contact 118*a* that is engaged by the spacing segment 136*a*.

As described above, in the exemplary embodiment the spacing segment 136*a* is engaged with the contacts 118*a* and 118*b*. The resistance force of the single contact 118*b* that resists movement of the spacing segment 136*a* in the direction of the arrow B is insufficient to cause the spacing segment 136*a* to deform and thereby damage the contact 118*a*. Rather, the resistance force will be overcome by the strength of the contact 118*a*,and the portion of the contact 118*b* engaged by the spacing segment 136*a* will deflect along with the corresponding portion of the contact 118*a*. Deflection of the portion of the contact 118*b* that is engaged by the spacing segment 136*a* may cause the mating interface 120 of the contact 118*b* to deflect approximately the same amount as the deflection of the mating interface 120 of the contact 118*a*.

Similar to the spacing segment 136*a*,the independent movement of the spacing segment 136*c* with respect to the spacing segment 136*b* enables the mating interface 120 of the contact 118*h* to be deflected a greater amount, by the wrong mating plug, than the mating interfaces 120 of the contacts 118*b-g* without damaging the contact 118*h*. The independent movement of the spacing segment 136*c* relative to the spacing segment 136*b* enables the portion of the contact 118*h* that is engaged by the spacing segment 136*c* to move relative to the portions of the contacts 118*c-f* that are engaged by the spacing segment 136*b*. Accordingly, the contacts 118*c-f* and the spacing segment 136*b* do not resist the greater deflection of the mating interface 120 of the contact 118*h* and the resulting deflection of the portion of the contact 118*h* that is engaged by the spacing segment 136*a*. The resistance force of the single contact 118*g* that resists movement of the spacing segment 136*c* in the direction of the arrow B is insufficient to cause the spacing segment 136*c* to deform and thereby damage the contact 118*h*. Rather, the resistance force will be overcome by the strength of the contact 118*h*,and the portion of the contact 118*g* engaged by the spacing segment 136*c* will deflect along with the corresponding portion of the contact 118*h*. Deflection of the portion of the contact 118*g* that is engaged by the spacing segment 136*c* may cause the mating interface 120 of the contact 118*g* to deflect approximately the same amount as the deflection of the mating interface 120 of the contact 118*h*.

Figure 5:
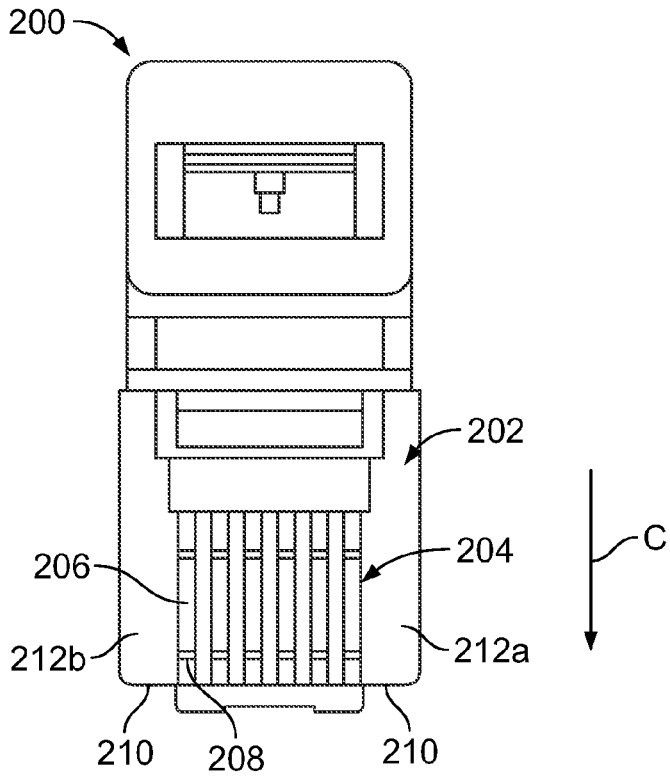
FIG. 5 (PRIOR ART)
FIG. 5 is a front elevational view of an exemplary six position plug.

As described above, insertion of the wrong mating plug into the cavity 108 (FIG. 1) of the electrical connector 100 (FIG. 1) may deflect the mating interface 120 of one or more of the contacts 118 within the array 117 a greater amount than the mating interface 120 one or more other contacts 118 within the array 117. For example, in the exemplary embodiment, the electrical connector 100 is an RJ-45 modular jack. Insertion of an RJ-11 plug into the cavity 108 of the electrical connector 100 may deflect the mating interfaces 120 of the contacts 118*a* and 118*h* a greater amount than the mating interfaces of the contacts 118*c-h*. Other examples include Registered Jack-14 (RJ-14) wiring standard plugs and Registered Jack-25 (RJ-25) wiring standard plugs. Insertion of an RJ-14 plug or an RJ-25 plug into the cavity 108 of the electrical connector may deflect the contacts 118*a* and 118*h* a greater amount than the contacts 118*c-h*. RJ-14 is a six position four-wire connector assembly, while RJ-25 is a six position six-wire connector assembly. FIG. 5 is a front elevational view of an exemplary six position plug 200. The plug 200 may be an RJ-11 plug, an RJ-14 plug, or an RJ-25 plug. In other words, the plug 200 may have the wiring pattern for an RJ-11 plug, may have the wiring pattern for an RJ-14 plug, or may have the wiring pattern for an RJ-25 plug. The plug 200 includes a housing 202 that holds an array 204 of mating contacts 206. In the exemplary embodiment, the plug 200 includes six mating contacts 206 such that the plug 200 is an RJ-25 plug. However, in embodiments wherein the plug 200 is an RJ-11 plug, the plug 200 may include only two contacts 206. In embodiments wherein the plug 200 is an RJ-14 plug, the plug 200 may include only four contacts 206. As illustrated in FIG. 5, mating ends 208 of the mating contacts 206 are recessed from a bottom edge 210 of the housing 202. The housing 202 includes extensions 212*a* and 212*b* that are raised in the direction of the arrow C relative to the recessed mating ends 208 of the mating contacts 206. The positions of the extensions 212*a* and 212*b* on the housing 202 of the plug 200 match the positions of the contacts 118*a* (FIGS. 3 and 4) and 118*h* (FIGS. 3, 4, and 6), respectively, within the contact array 117. Accordingly, when the plug 200 is inserted into the cavity 108 (FIG. 1) of the electrical connector 100 (FIG. 1), the bottom edges 210 of the extensions 212*a* and 212*b* press against the respective contacts 118*a* and 118*h*.

FIG. 6 is a side elevational view of the contact sub-assembly 110 illustrating the deflection of the mating interface 120 of, and the spacing segment 136*a* associated with, the contact 118*a* by the exemplary plug 200. When the plug 200 is inserted into the cavity 108 (FIG. 1) of the electrical connector 100 (FIG. 1), the extensions 212*a* and 212*b* of the plug housing 202 press against the mating interfaces 120 of the contacts 118*a* and 118*h*,respectively. The extension 212*b* and the contact 118*h* are not visible in FIG. 6. The extensions 212*a* and 212*b* deflect the mating interfaces 120 of the respective contacts 118*a* and 118*h* in the direction of the arrow B, which is generally toward the base 130.

As can be seen in FIG. 6, the deflection of the mating interface 120 of the contact 118*a* causes the spacing segment 136*a* of the spacing member 136 to move relative to the spacing segment 136*b* of the spacing member 136. More particularly, the spacing segment 136*a* moves relative to the spacing segment 136*b* in the direction B (generally toward the base 130). In other words, as shown in FIG. 6, the spacing segment 136*a* has moved relative to the base 130 a greater amount than the spacing segment 136*b* has moved relative to the base 130. In some embodiments, the spacing segment 136*b* remains approximately stationary relative to the base 130 as the contacts 118*a* and 118*h* are deflected by the extensions 212*a* and 212*b* of the plug 200. However, the spacing segment 136*b* may alternatively move slightly toward the base 130 due to the deflection of the mating interfaces 120 of the contacts 118*b-g* (FIGS. 3 and 4) via engagement with the six mating contacts 206 (FIG. 5) of the plug 200. Although not visible in FIG. 6, the spacing segment 136*c* moves relative to the spacing segment 136*b* in a substantially similar manner to that of the spacing segment 136*a*. Movement of the spacing segment 136*c* relative to the spacing segment 136*b* will therefore not be described in more detail herein. The independent movement of each of the spacing segments 136*a* and 136*c* with respect to the spacing segment 136*b* may enable the plug 200 to be inserted into the cavity 108 of the electrical connector 100 without damaging the contacts 118*a* and 118*h* of the electrical connector 100.

In embodiments wherein the plug 200 is an RJ-11 plug, the contacts 118*d* and 118*e* are engaged with and electrically connected to the two mating contacts of the RJ-11 plug. Accordingly, the electrical connector 100 is operatively connected to the RJ-11 plug such that the electrical connector 100 and the RJ-11 plug mated therewith transmit electrical signals, data, power, ground, and/or the like therebetween. Similarly, the electrical connector 100 may be operatively connected to an RJ-14 plug when the RJ-14 plug is received within the cavity 108 of the electrical connector 100. More particularly, in embodiments wherein the plug 200 is an RJ-14 plug, the contacts 118*c-f* are engaged with and electrically connected to the four mating contacts of the RJ-11 plug.

Referring again to FIG. 4, in the exemplary embodiment, the spacing member 136 covers and engages an approximate entirety of a circumference of the outer surface 157 of each contact 118 (along a portion of the length of the contact 118). Specifically, the spacing member 136 includes a plurality of openings 300. Each contact 118 extends through a corresponding one of the openings 300 and the surface(s) of the spacing member 136 defining each opening 300 covers and engages an approximate entirety of the circumference of the outer surface 157 of the corresponding contact 118. Accordingly, in the exemplary embodiment, each contact 118 is held by the spacing member 136. Alternatively, the spacing member 136 only covers and/or engages a portion of the circumference of the outer surface 157 of one or more of the contacts 118. For example, the spacing member 136 may only cover and/or engage a portion or all of only some of the side surfaces 157*a*,157*b*,157*c*,and/or 157*d* of one or more of the contacts 118. In such an embodiment wherein the spacing member 136 covers and/or engages only a portion of the circumference of the outer surface 157 of one or more of the contacts 118, the spacing member 136 may not hold one or more of the contacts 118, but rather may only space the contact(s) 118 apart by the predetermined pitch P. For example, in an alternative embodiment, the spacing member 136 may include a plurality of fingers (not shown) that extend between each of the contacts 118, wherein the spacing member 136 only engages and covers at least a portion of the side surfaces 157*b* and 157*d* (whether or not any portion of the spacing member 136 covers a portion or all of any of the side surfaces 157*a* and/or 157*c*).

In the exemplary embodiment, the spacing member 136 engages each contact 118 at a location along the length of the contact 118 that is along the intermediate segment 158. In other words, the spacing member 136 engages each contact 118 at a location along the length of the contact 118 that is between the mating interface 120 and the terminating end 154. Specifically, in the exemplary embodiment, the spacing member 136 engages each contact 118 at the cross-over segment 170 (if the corresponding contact includes a cross-over segment 170). In addition or alternative to engaging each contact 118 adjacent the cross-over segment 170, the spacing member 136 may engage each contact 118 at, and/or extend along, any other location along the intermediate segment 158. Optionally, the portion of the length of each contact 118 that the spacing member 136 extends along is entirely along the intermediate segment 158. In other words, an entirety of the spacing member 136 is optionally located along the intermediate segment 158.

The spacing member 136 may be formed from any suitable material(s) having dielectric properties, such as, but not limited to plastic, acrylic, epoxy, resin, and/or the like. Moreover, the spacing member 136 may be formed using any process, method, means, structure, and/or the like, such as, but not limited to, molding, extrusion, a solidification and/or curing process, and/or the like. In some embodiments wherein the spacing member 136 is not formed around (e.g., over molded) the contact array 117, the spacing member 136 may be attached to the array using any suitable process, method, structure, means, and/or the like, such as, but not limited to, using an adhesive, bonding the spacing member 136 to the contact array 117, using a tape, and/or the like. In the exemplary embodiment, the spacing member 136 is molded over the contact array 117 using any molding process, such as, but not limited to, over-molding, injection molding, and/or the like.

The embodiments described and/or illustrated herein provide an electrical connector that is capable of receiving the wrong mating plug therein without damaging contacts of the electrical connector. For example, the embodiments described and/or illustrated herein provide an RJ-45 jack that is capable of receiving an RJ-11 plug, an RJ-14 plug, and/or an RJ-25 plug therein without damaging contacts of the electrical connector. The embodiments described and/or illustrated herein may provide an RJ-45 modular jack that is capable of operatively connecting to an RJ-11 plug and/or an RJ-14 plug without damaging contacts of the RJ-45 jack.

Exemplary embodiments are described and/or illustrated herein in detail. The embodiments are not limited to the specific embodiments described herein, but rather, components and/or steps of each embodiment may be utilized independently and separately from other components and/or steps described herein. Each component, and/or each step of one embodiment, can also be used in combination with other components and/or steps of other embodiments. When introducing elements/components/etc. described and/or illustrated herein, the articles "a", "an", "the", "said", and "at least one" are intended to mean that there are one or more of the element(s)/component(s)/etc. The terms "comprising", "including" and "having" are intended to be inclusive and mean that there may be additional element(s)/component(s)/etc. other than the listed element(s)/component(s)/etc. Moreover, the terms "first," "second," and "third," etc. in the claims are used merely as labels, and are not intended to impose numerical requirements on their objects. Dimensions, types of materials, orientations of the various components, and the number and positions of the various components described and/or illustrated herein are intended to define parameters of certain embodiments, and are by no means limiting and are merely exemplary embodiments. Many other embodiments and modifications within the spirit and scope of the claims will be apparent to those of skill in the art upon reviewing the description and illustrations. The scope of the subject matter described and/or illustrated herein should therefore be determined with reference to the appended claims, along with the full scope of equivalents to which such claims are entitled. Further, the limitations of the following claims are not written in means—plus-function format and are not intended to be interpreted based on 35 U.S.C. §112,sixth paragraph, unless and until such claim limitations expressly use the phrase "means for" followed by a statement of function void of further structure.

While the subject matter described and/or illustrated herein has been described in terms of various specific embodiments, those skilled in the art will recognize that the subject matter described and/or illustrated herein can be practiced with modification within the spirit and scope of the claims.

What is claimed is:

1. A contact sub-assembly for an electrical connector, said contact sub-assembly comprising:

a base having a base surface;

an array of contacts extending along the base surface of the base, each contact extending along a length from a terminating end to a tip end, each contact having a mating interface located along the length of the contact between the terminating end and the tip end; and a spacing member formed separately from the base, the spacing member engaging at least some of the contacts for positioning the contacts relative to each other within the array, wherein the spacing member comprises first and second spacing segments that are discrete from each other and that are configured to move relative to each other.

2. The contact sub-assembly according to claim 1, wherein the first and second spacing segments are moved relative to each other when at least one of the first spacing segment or the second spacing segment is engaged by a mating plug.

3. The contact sub-assembly according to claim 1, wherein the second spacing segment is configured to move relative to the first spacing segment in a direction generally toward the base.

4. The contact sub-assembly according to claim 1, wherein the second spacing segment is configured to move relative to the base a greater amount than the first spacing member moves relative to the base.

5. The contact sub-assembly according to claim 1, wherein the array of contacts is arranged to include two opposite outer contacts and inner contacts that extend between the outer contacts, the first spacing segment engaging at least one of the inner contacts, the second spacing segment engaging one of the outer contacts.

6. The contact sub-assembly according to claim 1, wherein the array of contacts is arranged to include two opposite outer contacts and inner contacts that extend between the outer contacts, the spacing member further comprising a third spacing segment that is discrete from the first and second spacing segments and is configured to move relative to the first spacing segment, the first spacing segment engaging at least one of the inner contacts, the second spacing segment engaging one of the outer contacts, the third spacing segment engaging the other outer contact.

7. The contact sub-assembly according to claim 1, wherein the spacing member engages the contacts at locations along the length of the contacts that are between the mating interface and the terminating end.

8. The contact sub-assembly according to claim 1, wherein at least one of the contacts comprises a cross-over segment that crosses one of over or under an adjacent contact within the array, the spacing member engaging the at least one contact at the cross-over segment.

9. The contact sub-assembly according to claim 1, wherein the first and second spacing segments of the spacing member abut each other.

10. The contact sub-assembly according to claim 1, wherein the first and second spacing segments are one of:

formed separately; or integrally formed and thereafter separated to define the first and second spacing segments.

11. The contact sub-assembly according to claim 1, wherein the spacing member at least one of:

covers at least portions of the contacts;

is molded over the contacts;

covers an approximate entirety of a circumference of an exterior surface of at least one of the contacts along a portion of the length thereof; or comprises an opening that extends through the spacing member and receives at least one of the contacts therethrough.

12. An electrical connector comprising:

a housing; and a contact sub-assembly held by the housing, the contact sub-assembly comprising:

a base having a base surface;

an array of contacts extending along the base surface of the base, each contact extending along a length from a terminating end to a tip end, each contact having a mating interface located along the length of the contact between the terminating end and the tip end; and a spacing member formed separately from the base, the spacing member engaging at least some of the contacts for positioning the contacts relative to each other within the array, wherein the spacing member comprises first and second spacing segments that are discrete from each other and that are configured to move relative to each other.

13. The electrical connector according to claim 12, wherein the first and second spacing segments are moved relative to each other when at least one of the first spacing segment or the second spacing segment is engaged by a mating plug.

14. The electrical connector according to claim 12, wherein the second spacing segment is configured to move relative to the base a greater amount than the first spacing member moves relative to the base.

15. The electrical connector according to claim 12, wherein the array of contacts is arranged to include two opposite outer contacts and inner contacts that extend between the outer contacts, the first spacing segment engaging at least one of the inner contacts, the second spacing segment engaging one of the outer contacts.

16. The electrical connector according to claim 12, wherein the array of contacts is arranged to include two opposite outer contacts and inner contacts that extend between the outer contacts, the spacing member further comprising a third spacing segment that is discrete from the first and second spacing segments and is configured to move relative to the first spacing segment, the first spacing segment engaging at least one of the inner contacts, the second spacing segment engaging one of the outer contacts, the third spacing segment engaging the other outer contact.

17. The electrical connector according to claim 12, wherein the spacing member engages the contacts at locations along the length of the contacts that are between the mating interface and the terminating end.

18. The electrical connector according to claim 12, wherein at least one of the contacts comprises a cross-over segment that crosses one of over or under an adjacent contact within the array, the spacing member engaging the at least one contact at the cross-over segment.

19. The electrical connector according to claim 12, wherein the first and second spacing segments of the spacing member abut each other.

20. A contact sub-assembly for an electrical connector, said contact sub-assembly comprising:

a base having a base surface;

an array of contacts extending along the base surface of the base, each contact extending along a length from a terminating end to a tip end, each contact having a mating interface located along the length of the contact between the terminating end and the tip end; and a spacing member formed separately from the base, the spacing member covering the contacts along a portion of the length thereof, wherein the spacing member is segmented into first and second spacing segments that are discrete from each other and that are configured to move independently from each other.

* * * * *